US007451956B2

(12) United States Patent
Bohlen

(10) Patent No.: US 7,451,956 B2
(45) Date of Patent: Nov. 18, 2008

(54) ADJUSTABLE BRACKET ASSEMBLY

(75) Inventor: Jorg Bohlen, Langen (DE)

(73) Assignee: Hunter Douglas Industries BV, El Rotterdam (NL)

( * ) Notice: Subject to any disclaimer, the term of this patent is extended or adjusted under 35 U.S.C. 154(b) by 278 days.

(21) Appl. No.: 11/187,487

(22) Filed: Jul. 22, 2005

(65) Prior Publication Data

US 2006/0016946 A1 Jan. 26, 2006

(30) Foreign Application Priority Data

Jul. 23, 2004 (EP) ..... 04077141

(51) Int. Cl.
*A47H 1/10* (2006.01)

(52) U.S. Cl. ..... 248/265; 248/220.21; 248/220.22; 248/221.11; 248/221.12; 248/223.41; 248/224.51; 248/224.61; 248/224.7; 248/224.8; 248/225.11; 248/314

(58) Field of Classification Search ..... 248/220.21, 248/220.22, 221.11, 222.11, 222.12, 223.41, 248/224.51, 224.61, 224.7, 224.8, 225.11, 248/314, 265
See application file for complete search history.

(56) References Cited

U.S. PATENT DOCUMENTS

| | | | |
|---|---|---|---|
| 3,030,060 | A | 4/1962 | Breuer |
| 3,463,217 | A | 8/1969 | Assael |
| 4,363,459 | A | 12/1982 | Holzer |
| 5,131,616 | A | 7/1992 | Biba |
| 5,779,206 | A | 7/1998 | Harris et al. |
| 2003/0221794 | A1 | 12/2003 | Morris |

*Primary Examiner*—J. Allen Shriver
*Assistant Examiner*—Nkeisha J Dumas
(74) *Attorney, Agent, or Firm*—Dorsey & Whitney LLP

(57) ABSTRACT

An adjustable bracket for mounting the headrail for a covering for architectural openings includes a stationary base member mountable on a wall or ceiling surface having a slot formed therein and a headrail holder connectable to the headrail and adjustably movable and operably connected within the elongated slot between fixed positions.

11 Claims, 5 Drawing Sheets

ADJUSTABLE BRACKET ASSEMBLY

CROSS REFERENCE TO RELATED APPLICATION

This application claims priority to European patent application No. 04077141.2, filed 23 Jul. 2004, which is hereby incorporated by reference as fully disclosed herein.

BACKGROUND OF THE INVENTION

1. Field of the Invention

This invention relates to an adjustable bracket assembly for mounting a head rail of a blind.

2. Description of the Related Art

Adjustable bracket assemblies have the possibility to adjust the spacing between a wall or ceiling and a head rail of a blind. They generally include a bracket body and a slide member co-operating with the bracket body. The bracket body is fixable to a structure such as a wall or ceiling. The slide member includes means for carrying a spring clip or the like for mounting a head rail of a blind. The slidable member is used to adjust the distance between the wall or ceiling and the mounted blind.

Such an adjustable bracket is e.g. known from U.S. Pat. No. 4,636,459. A drawback of this bracket is that in order to adjust the distance between the mounted blind and the wall or ceiling a fastener, such as a screw, must be loosened and that such fastener can generally not be reached without dismounting the blind from the bracket.

Another adjustable bracket is described in U.S. Pat. No. 5,131,616 where the slide body (11,51) includes clamping means (25, 75) for releasably engaging the slide body (11,51) to the bracket body in different positions along the bracket. The clamping means being either a latch arm (25) integrally formed to the slide body (11) having a nose (25*a*) for engaging detents or notches (19) on the bracket body (10) or a pivotable clamp device including a lever (75) and a cam member (76), the cam member (76) being positioned between the upper side of the bracket arm and the under side of the upper portion (73) of the slide body (51).

Although the bracket can now be adjusted without having to unscrew a fastener, there are several drawbacks. The latch arm with nose has as drawback that it is actuated by a pivotal movement and it therefore has to extend sideways from the slide body. Also there is a less secure single sided engagement of the slide body to the bracket. For ceiling mounted brackets where the bracket portion that carries the head rail is vertically oriented, such a single sided latching will hardly prevent the head rail from sliding under its own weight through the engagement of the latch arm and downwardly along the bracket. The lever and cam member latching means is also a pivotably actuated latching means. Here the drawback lies in the fact that a very small lever must be handled in a small space. For disengaging it is generally possible to push the lever with the end of a screw-driver to pivot into the unlatched position. But the reverse pivot movement of the lever for latching requires that one can actually hold the lever. This means that there must be a handling space over the bracket, resulting in a bracket assembly that must be mounted to a wall relatively far removed from the ceiling or to a ceiling relatively far removed from the wall to allow for the necessary handling space.

It is therefore an object of the invention to provide an adjustable bracket assembly of which the clamping means is operated by linear movement of the actuating means, the linear movement being in the same direction as the direction of adjustment of the head rail.

SUMMARY OF THE INVENTION

The invention is directed to a bracket assembly for adjustably mounting a head rail in spaced relationship to a wall or ceiling said assembly comprising a stationary base member for mounting to a wall or ceiling surface, the base member comprising an elongated support leg and the support leg having an elongated slot comprised therein, the elongated slot comprising at least opposite first and second inner wall surfaces; a head rail holder for carrying a head rail, the head rail holder being slidably mounted to the support leg by a stemmed fastener projecting through the slot of the support leg such that the head rail holder is slidable in first and second directions along the support leg; clamping means engageable with the support leg for releasably retaining the head rail holder in different adjusted positions along the support leg, and actuating means for releasing or engaging the clamping means wherein the clamping means and the actuating means are mounted to the support leg by the stemmed fastener and wherein the actuating means is operatively connected to the clamping means allowing linear actuating movements relative thereto.

Preferably the clamping means is an expandable, resilient means that in a first expanded position engages at least one of the inner wall surfaces of the elongated slot of the support leg of the stationary base member and retains the head rail holder against linear movement in at least one direction and in second non-expanded position is free of the at least one of the inner wall surfaces of the elongated slot allowing linear movement of the head rail holder in both directions.

More preferably the clamping means is an expandable resilient means comprising an opening through which the stemmed fastener can project and at least a pair of engaging legs for resiliently engaging the first and second inner wall surfaces.

Also according to the invention the actuating means includes an actuator body that is slidably contained between the first and second inner wall surfaces of the slot and the clamping means that are contained within said actuator body while allowing engagement of the clamping means to the inner wall surfaces of the slot.

In a preferred embodiment the actuator body includes an oblong hole such that when the clamping means are in a first position of engagement to the inner wall surfaces of the slot and the fastener is retained in that first position, the actuator body is slidable relative to said clamping means.

Advantageously the actuator body further includes a pair of left and right actuator walls which upon linear movement of the actuator body relative to the clamping means act on the clamping means disengaging the clamping means from the inner wall surfaces of the slot.

In the preferred embodiment the clamping means is a torsion spring comprising at least one winding, an opening through which the stemmed fastener can project and at least one pair of engaging spring legs for resiliently engaging the first and second inner wall surfaces.

In another preferred embodiment the clamping means is an X-shaped resilient body having two pairs of engaging legs.

BRIEF DESCRIPTION OF THE DRAWINGS

Further aspects of the invention will be apparent from the detailed description below of particular embodiments and the drawings thereof, in which.

DETAILED DESCRIPTION OF THE PREFERRED EMBODIMENTS

Figure 1:
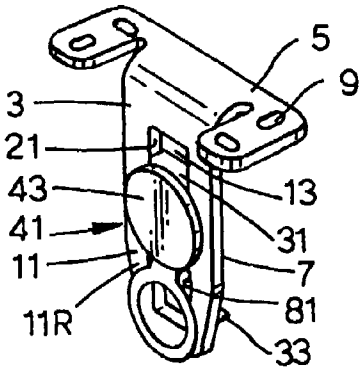
FIG. 1 is a schematic perspective view of a first embodiment of the bracket assembly of the invention seen from the rear.
Figure 2:
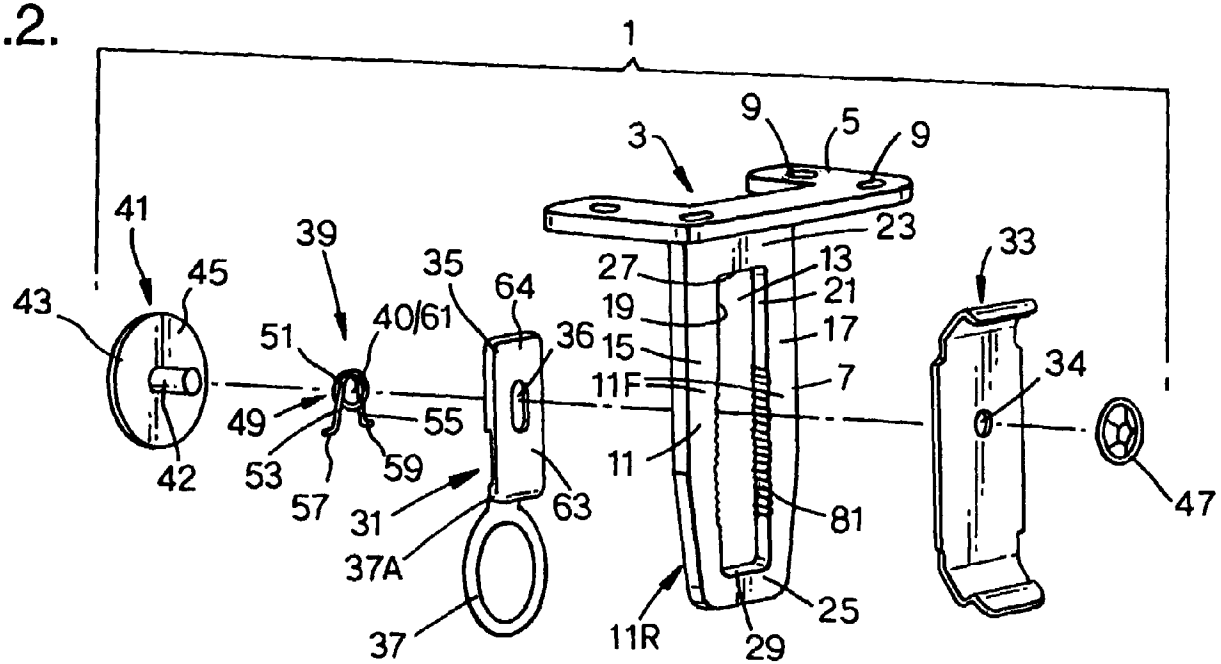
FIG. 2 is an exploded view of the first embodiment of the bracket assembly of the invention.

FIGS. 1 and 2 show a first embodiment of the bracket assembly 1 of the invention in a perspective view. The bracket assembly comprises a generally L-shaped stationary base member 3 with a mounting portion 5 and a support leg 7. The mounting portion 5 with screw holes 9 is for mounting the base member 3 to a surface such as a wall or a ceiling. The base member 3 further includes a support leg 7 which is usually generally perpendicular to the mounting portion 5. The particular position of the bracket of FIG. 1 with the support leg 7 in a generally vertical direction is for mounting the bracket to a ceiling. The support leg 7 will support the head rail (not shown) and is a generally rectangular shaped support web 11 with an elongated, also generally rectangular slot 13 through the web. The elongated slot 13 includes a pair of left and right parallel and spaced apart side walls 15, 17 with opposite inner left or first and right or second side wall surfaces 19, 21 and a pair of opposite and parallel spaced apart top and bottom walls 23, 25 with inner top and bottom surfaces 27, 29. A head rail holder 33 is slidably mounted to the support leg 7 by a suitable stemmed fastener 41 projecting through the slot. The support leg 7 and its slot 13 further carry a clamping means 39 (not visible in FIG. 1) for releasably retaining the head rail holder 33 in different adjusted positions along the support leg 7 and an actuating means 31 for operating the clamping means between a lock and a release mode. Both the clamping means 39 and the actuating means 31 are mounted to the support leg by the same stemmed fastener 41 as the head rail holder 33. The actuating means comprises a slide body 35 that is slidably contained in the slot 13 between the left and right inner wall surfaces 19, 21 and a actuator grip 37 that extends adjacent the support leg 7 for operating the actuator.

As is best visible in FIG. 2, which shows an exploded view of the first embodiment bracket assembly, the actuating means 31 includes an actuator body 35 and a actuator grip 37. The actuator body 35 is a generally rectangular body suitably sized for it to be slidable in slot 13 of the support leg 7. The actuator body 35 includes a generally rectangular web 63. The web having an upper portion 64 which includes a recess 65 as is best visible in FIGS. 3 and 4. The recess 65 is a generally U-shaped recess. The actuator body hole 36 is located in the recess 65 and is preferably a general oval oblong opening with a longitudinal axis extending co-planar with to a longitudinal axis of the rectangular actuator body. The U shaped recess 65 with its oblong hole 36 is bordered by a left, right actuator walls 67,69 and top recess wall 71.

The actuator grip 37 of the first embodiment is a ring-like portion extending from the lower part of the actuator body web 63 for operating the actuating means by pulling. Other shapes are also possible. The actuator body 35 is mounted to the slot by the stemmed fastener 41; the stem 42 of the fastener 41 projecting through hole 36. The stem 42 of the fastener is long enough to also project through slot 13 of the support leg 7 of the bracket body 3. The fastener 41 is provided with a large circular head, the inner surface 45 of the fastener head 43 lies against the rear surface 11R of the support web 11 of the support leg 7 and prevents the actuator body 35 from falling out of the slot 13 at that side of the support leg. This is also visible in FIG. 1. The end portion of the fastener stem 42 projects from the other side of support leg 7 and through an opening 34 of the head rail holder 33. A circlip 47 on the end portion of the fastener stem 42 holds the head rail holder 33 against the front surface 11 Front of the support web. This arrangement effectively prevents the actuator body from falling out of the slot 13 of the support web 11 and carries the head rail holder. The stemmed fastener operatively connects the support leg 7, the head rail holder 33, the clamping means 39 and the actuating means 31.

FIGS. 2-5 illustrates the assembly and operation of the bracket assembly.

The clamping means 39 is engageable with at least one of the inner left and right inner wall surfaces 19, 21 of the slot 13 of the support leg, such that once engaged the head rail holder is retained in a first desired position on the support leg against movement in at least one direction. The clamping means 39 is provided with a through hole 40 through which the stemmed fastener 41 can project for mounting clamping means 39 to the support leg 7 of the base member 3. The cross-sectional shape and size of the clamping means hole 40 is generally the same as that of the stem of the fastener, but slightly larger to allow the stem of the fastener to project through it.

The clamping means 39 is preferably a torsion spring 49. In the first embodiment as shown in FIGS. 1-5 it is a torsion spring 49 with a single winding 51 and a pair of left and right legs 53, 55 extending at an angle and downwardly on either side from the winding. The legs having left and right leg end portions 57,59 extending like feet at an angle from the legs. The eye 61 of the winding 51 being the hole 40 of the clamping means for the stem of the fastener to project through.

Figure 3:
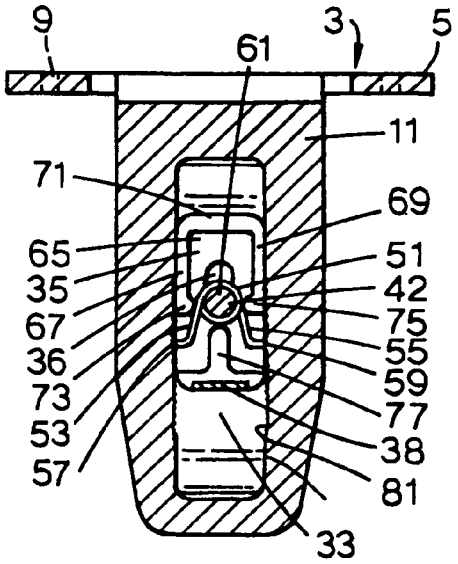
FIG. 3 shows the first embodiment bracket assembly in a cross-section from the rear and at the level of the actuator; the clamping means are in a first engaged position preventing adjustment of the position of the head rail holder.
Figure 4:
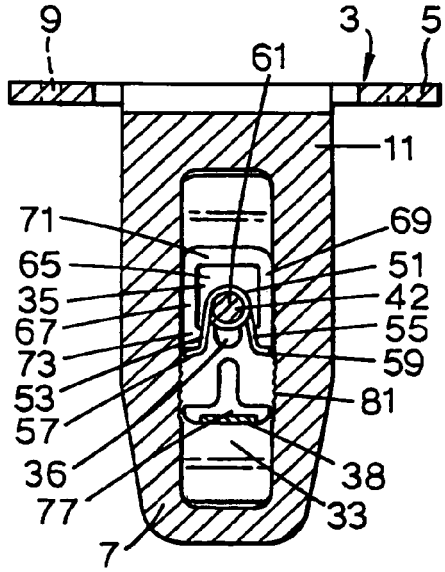
FIG. 4 shows the first embodiment bracket assembly in a cross-section from the rear and at the level of the actuator; the clamping means are in a second un-engaged position allowing adjustment of the position of the head rail holder.

The actuator body 35 of the actuator 31 accommodates the clamping means such as the torsion spring 49 in a recess 65 in an upper portion 64 of a generally rectangular web 63 of as is best visible in FIGS. 3 and 4. The recess 65 is a generally U-shaped recess. The hole 36 of the actuator body 35 is located in recess 65 and is preferably a general oval oblong opening with a longitudinal axis extending co-planar with to a longitudinal axis of the actuator body web 63. The U shaped recess 65 with its oblong hole 36 is bordered by a left, right actuator walls 67,69 and top recess wall 71. The left and right actuator walls 67,69 extend downward until the level of the bottom of oblong hole 36 and preferably a bit further and include left and right thickened bottom portions 73, 75 that are inwardly slightly thickened to ensure good contact with the torsion spring's feet 57, 59 as is explained below in relation to the adjustability of the bracket assembly. Directly below the hole 36 extends a stiffening rib 77 and since the left and right actuator walls 67,69 ended at this level, the sides are open thus allowing the torsion spring's feet portions 57,59 to extend past the sides of the body and to engage the left and right slot wall's inner surfaces 19,21. At the horizontal bottom portion of the stiffening rib 77 the attachment seam 38 of the actuator grip 37 is visible in cross-section.

The oblong hole 36 of the actuator body 35 allows linear, vertical movement of the actuator body 35 relative to the stem 42 of the fastener 41 thus relative to the torsion spring 49, as will be explained below in relation to the adjustability of the bracket assembly. The range of this movement is limited by the longitudinal length of the oblong opening 36.

The torsion spring 49 is designed so that it automatically is biased into engagement with the left and right slot wall's inner surfaces 19,21, resulting in a first situation as is shown in FIG. 3, where the head rail carrier 33 is fixed by the stemmed fastener 41 and the torsion spring 49 in a first position relative to the support leg against movement in a downward direction.

The distance between the spring feet 57,59 is chosen such that it is at least slightly bigger than the width of the slot 13. The spring's force will bias the spring feet 57,59 to expand to it's widest position. So if the width of the slot 13 is slightly smaller, the spring will be biased into engagement with the inner wall surfaces. Even with the torsion spring in an engage or locked position, the oblong hole 36 of the actuator body 35 allows relative sliding movement of the actuator body 35 within the slot 13 of the bracket. Extending downward from the bottom portion at seam 38 of the actuator body web 63 is actuator grip 37 for operating the actuator 31. The actuator grip is best visible in FIG. 1.

Figure 5:
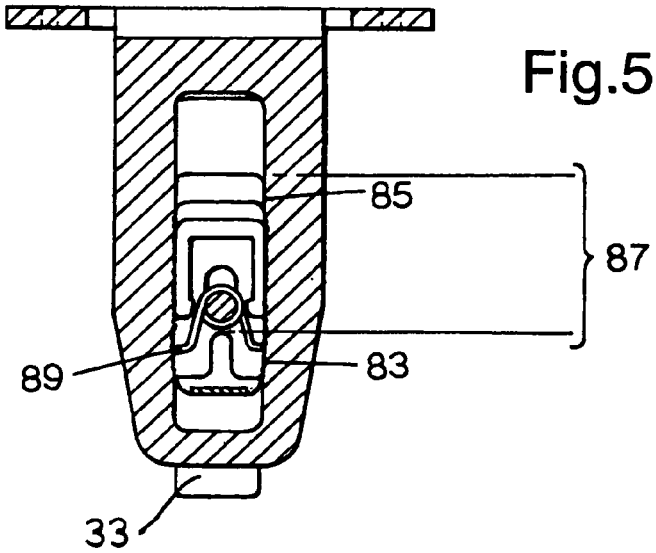
FIG. 5 shows the first embodiment bracket assembly in a cross-section from the rear and at the level of the actuator where the position of the head rail holder is lower relative to the position in FIG. 3 and the clamping means are in the engaged position preventing further adjustment of the position of the head rail holder.

In operation, when the actuator grip 37 is pulled downwardly the actuator body 35 will slide downwardly and over the clamping spring 49. As the actuator body 35 is being pulled downwardly over the spring, the bottom portions of the left and right actuator walls 73, 75 bear down on the left and right spring feet 57, 59 pushing them inwardly and thus disengaging the spring leg ends 57,59 from the inner slot wall surfaces 19,21. This second position of the actuator 31 is shown in FIG. 4. Here the clamping means are in a second or release mode with the spring leg ends 57,59 disengaged and the head rail holder 33 and an installed head rail or blind can now be moved relative to the bracket support leg 7. The downward movement of the actuator body 35 will be stopped when the top of the oblong hole 36 abuts against the stationary stem 42 of fastener 41. Continued downward pulling of the actuator grip 37 will now result in movement of the head rail holder 33. The position of the head rail holder can thus be adjusted to a desired new position. Once that desired new position is reached the actuator grip 37 can be released. By releasing the grip the resilient spring legs expand outward and lock by to the inner surfaces 19,21 of the slot. This new position 89 of the legs relative to the inner wall surfaces of the slot 13 is shown in FIG. 5. The actuator 31 will by the same action be pushed back to its original position relative to the spring as shown in FIG. 3. FIG. 5 shows the bracket assembly with head rail holder 33 in its new, adjusted position, which is lower relative to the original position of FIG. 3. The clamping spring is engaged to the slot.

In order to ensure a good grip of the spring leg's feet 57,59 on the inner surfaces of the left and right side walls 19,21 of slot 13 it is desirable that these surfaces are been provided with a ribbed profile. Such a profiled surface 81 is shown in the FIGS. 1-5 of the first embodiment. Upper rib 83 and lower rib 85 indicate the outer limits for the spring leg's feet 57,59 to engage the profiled inner surfaces 19,21. Range 87 shows the possible relative positions of stem 41 and therefore of the center opening 34 of the head rail holder.

Figure 6B:
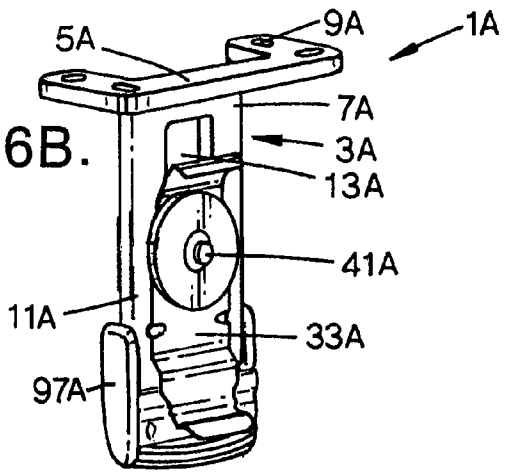
FIG. 6B is a schematic perspective view of a second embodiment of the bracket assembly of the invention seen from the front side.
Figure 6A:
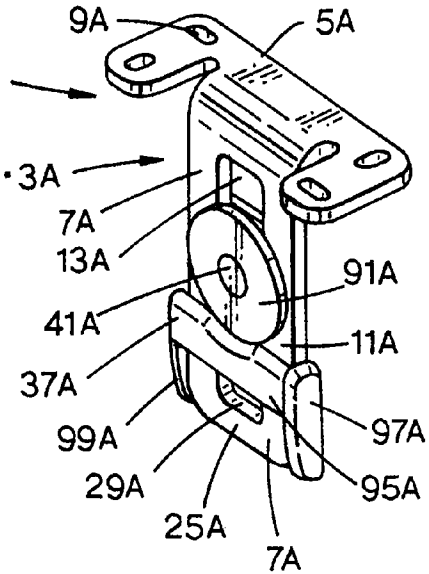
FIG. 6A is a schematic perspective view of a second embodiment of the bracket assembly of the invention seen from the rear side.
Figure 7:
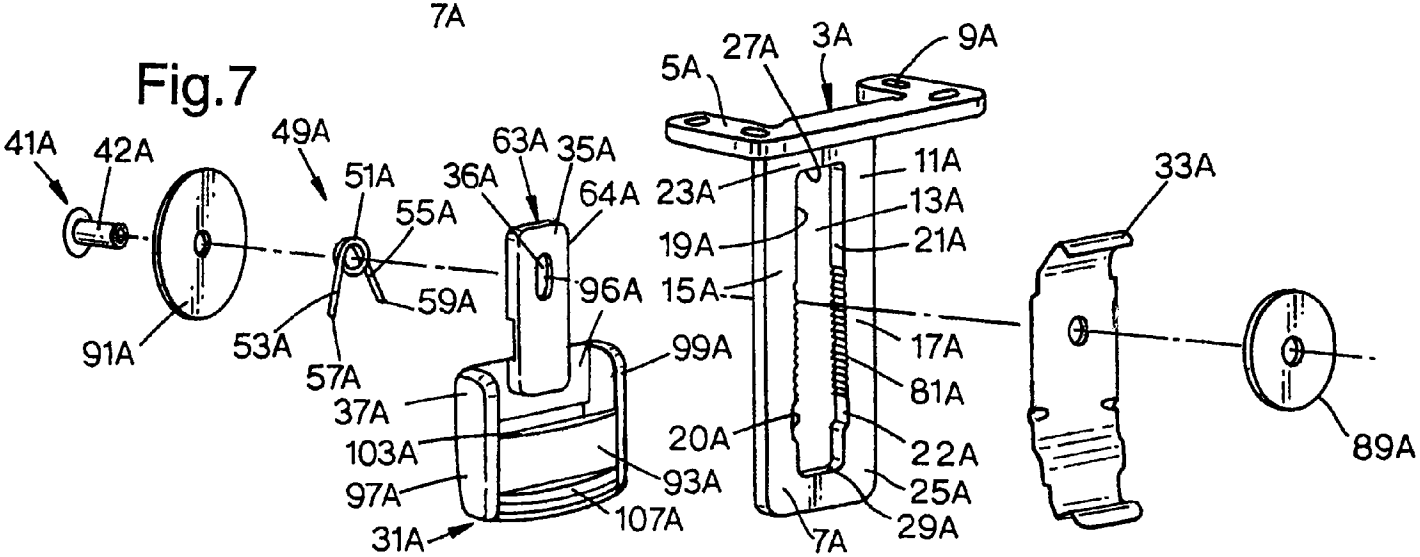
FIG. 7 is an exploded view of the second embodiment of the bracket assembly of the invention.
Figure 8:
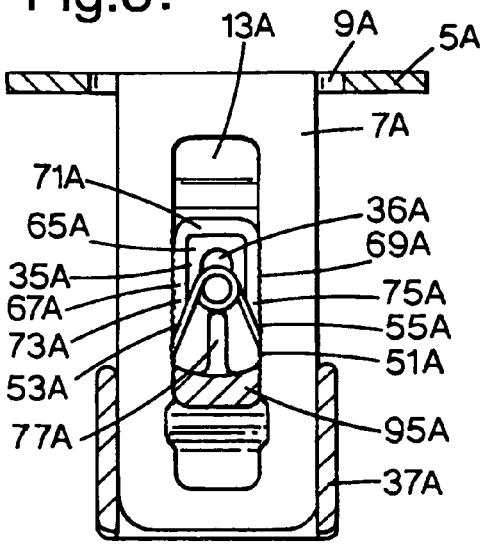
FIG. 8 shows the second embodiment bracket assembly in a cross-section from the rear and at the level of the slide body; the clamping means are in a first engaged position preventing adjustment of the position of the head rail holder.

A second embodiment of the bracket is shown in FIGS. 6-8, in the description of this embodiment like parts have the same referral numbers as those used in the first embodiment with suffix A.

The second embodiment bracket assembly 1A comprises the same parts as the first embodiment. FIGS. 6A and 6B show the generally L-shaped stationary base member 3A, the mounting portion 5A, the support leg 7A, the screw holes 9A and the generally rectangular shaped support web 11A with the elongated, also generally rectangular slot 13A in the support web 7A. The elongated slot 13A having the left and right sidewalls 15A, 17A. the actuating means 31A and the head rail holder 33A.

As is best visible in FIG. 7, the elongated slot 13A includes a pair of left and right parallel and spaced apart side walls 15A, 17A with opposite inner left or first and right or second surfaces 19A, 21A and a pair of opposite and parallel spaced apart top and bottom walls 23A, 25A with inner top and bottom surfaces 27A, 29A. The left and right inner wall surfaces 19A, 21A are provided with a suitable profile 81A, similar to the first embodiment. Near the bottom wall 25A, the slot is slightly wider by the accommodation of a left and right recess 20A, 22A in the left and right inner wall surfaces 19A, 21A. These surfaces are not profiled. The support leg 7A and its slot 13A carry an actuating means 31A. the actuating means 31A is slidably contained in slot 13A between the left and right inner wall surfaces 19A, 21A and carries by a stemmed fastener 41A a head rail holder 33A.

FIG. 7 further shows the actuator 31A with the grip 37A and the actuator body 35A. The actuator grip 37A is a generally rectangular sleeve-like member having a pair of opposite and parallel front and rear walls 93A, 95A and interconnecting left and right side walls 97A, 99A which connect the front and rear walls forming a sleeve-like grip body. When assembled to the support leg 7A, the actuator grip 37A partially surrounds the support leg, the side walls 97A, 99A being parallel to the sides of the support leg. This makes the actuator grip is now very easy to handle without it expanding the size of the bracket assembly.

The actuator body 35A extends from the inner surface 96A of the rear wall of the actuator grip 37A and is shaped similar to the actuator body of the first embodiment, in that it is a generally rectangular web 63A, having an upper portion 64A which includes the generally U-shaped recess 65A. The actuator body mounting opening 36A is located in the recess 65A and is preferably a general oval oblong opening with a longitudinal axis extending co-planar with to a longitudinal axis of the rectangular actuator body. The U shaped recess 65A with its oblong hole 36A is bordered by a left, right actuator walls 67A,69A and top recess wall 71A.

For assembly purposes the front wall 93A of the actuator grip 37A is not directly opposite the rear wall 95A, but preferably starts at a lower level along the side walls 97A, 99A. This way the inner surface 96A of rear wall 95A and its extending actuator body 35A, are kept free for the slot of the support leg 7A to be put over it. The inner bottom wall surface 29A abutting against the bottom part of the actuator body, while the rear surface of the bottom wall 25A of the support leg 7A lies against the inner surface 96A of the rear wall 95A. This position also ensures that the legs of the clamping means lie next to the left and right recesses 20A, 22A facilitating its assembly to the slot.

When large and heavy blinds are mounted the weight of the blind on the clip forces the lower halve of the clip against the front wall 93A of the actuator grip 37A. The weight of the blind closes the normally present small gap of approximately 0.2 mm, and the front wall 93A provides support and prevents a head rail and blind (not shown) when mounted to the head rail holder 33A from sliding downwardly and prevents the head rail holder from flexing downward under the weight of a blind and thus from disengaging the blind from the head rail holder 33A under its own weight. Further the front wall 93A is provided with a bottom ledge 107A extending further out than the rim. The ledge 107A provides a wedge surface for a tool that can be pushed between the ledge and the head rail holder 33A for lifting the head rail holder from rim 103A when it is desired to open the spring clip head rail holder 33A. This is particularly necessary for heavy blinds that are mounted to a vertically oriented the support leg 7, 7A and a spring clip is used as head rail holder.

The actuator body 35A and the clamping means 39A are similarly assemble as to those of the first embodiment, in that the recess 65A of actuator body 35A accommodates the torsion spring 49A. The left and right actuator walls 67A,69A extend downward until the level of the bottom of oblong hole 36A or a bit further. Directly below the hole 36A extends a stiffening rib 77A and since the left and right actuator walls 67A,69A ended at this level, the sides are open thus allowing the ends 57A, 59A of the torsion spring left and right legs to engage the left and right slot wall's inner surfaces 19A,21A. The clamping means 39A of the second embodiment is preferably also a torsion spring 49A with a single winding 51A and a pair of left and right legs 53A, 55A extending downward on either side from the winding. Unlike the previous embodiment there are no extending feet portions but straight end portions 57A, 59A. This makes their assembly of the spring into the slot easier, as does the wider lower portion of the slot between left and right recesses 20A, 22A. The actuator body 35A is also adjusted to the shape of the clamping means 39A, in that the left and right lower portions 73A,75A of the left and right actuator walls 67A, 69A are slanted downwardly and outwardly.

The stemmed fastener 41A can be projected through the parts and held in place by front and rear circlips or other closure means. Front and rear retaining discs 89A 91A provide the surfaces needed to securely hold the parts together and prevents the actuator body 35A from falling out of the slot 13A. Also headed rivet type fasteners as used in the first embodiment are more expensive and with the separate parts it is easier to chose type and size of the retaining discs.

FIG. 8 shows the arrangement of the actuator body 35A, the clamping means 39A and the operation of the assembly.

In operation, when the actuator grip 37A is pulled downwardly the actuator body 35A will slide downwardly and over the clamping spring 49A. As the actuator body 35A is being pulled downwardly over the spring, the bottom portions of the left and right actuator walls 73A, 75A bear down on the left and right spring ends 57A, 59A pushing them inwardly and thus disengaging the spring leg ends 57A,59A from the inner slot wall surfaces 19A,21A. The downward movement of the actuator body 35A will be stopped when the top of the oblong hole 36A abuts against the stationary stem 42A of fastener 41A. Continued downward pulling of the actuator grip 37A will now result in movement of the head rail holder 33A. The position of the head rail holder can thus be adjusted to a desired new position. Once that desired new position is reached the actuator grip 37A can be released. By releasing the grip the resilient spring legs will expand to their widest position and lock by to the inner surfaces 19,21 of the slot.

In order to ensure a good grip of the spring leg ends 57A, 59A on the inner surfaces of the left and right side walls 19A,21A of slot 13A it is desirable that these surfaces are been provided with a suitable ribbed profile 81A.

Figure 9:
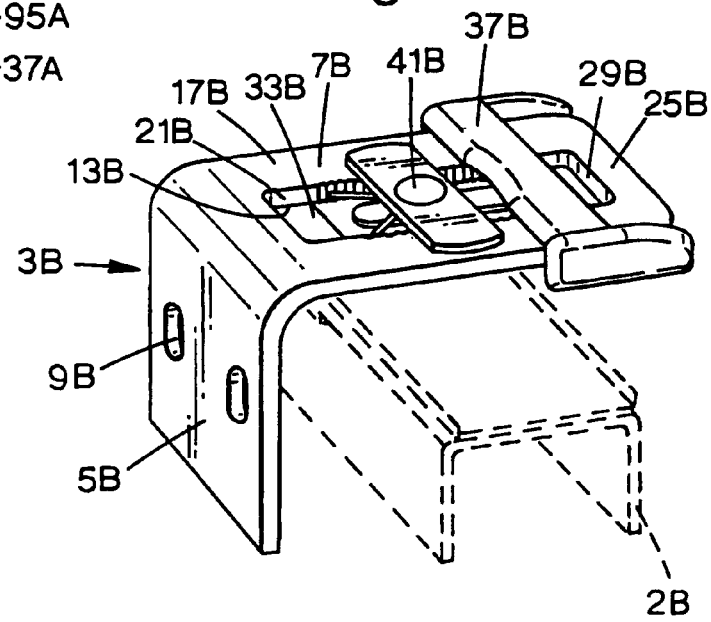
FIG. 9 shows a schematic perspective view of the third embodiment bracket
Figure 10:
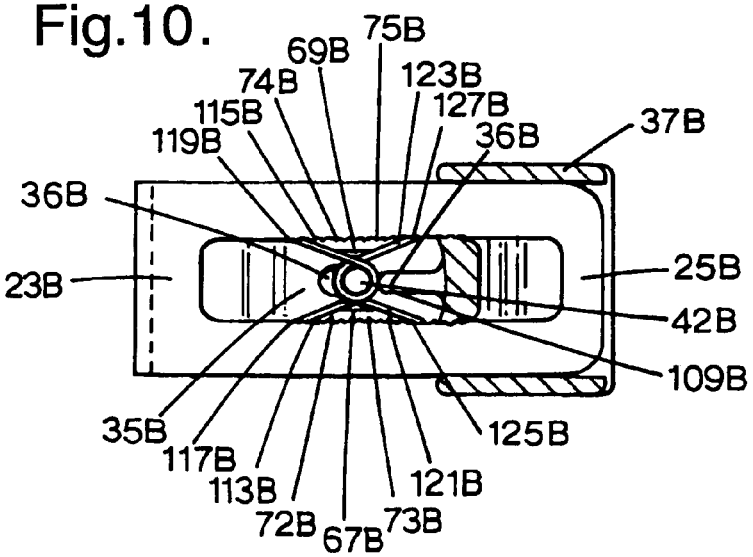
FIG. 10 shows the third embodiment bracket assembly in a cross-section from the rear and at the level of the actuator; the clamping means are in engaged position preventing adjustment of the position of the head rail holder.

A third embodiment is shown in FIGS. 9 and 10 and is specifically for use in wall mounted brackets with the support leg extending generally horizontally.

In the description of this third embodiment like parts have the same referral numbers as those used in the first embodiment with suffix B.

The third embodiment bracket assembly 1B comprises the generally same parts as the first and second embodiments. FIG. 9 show the generally L-shaped stationary base member 3B, the mounting portion 5B, the support leg 7B, the screw holes 9B and the generally rectangular shaped support web 11B with the elongated, also generally rectangular slot 13B in the support web 7B. The elongated slot 13B also having the left and right sidewalls 15B, 17B, the actuating means 31B and the head rail holder 33B. In FIG. 9 in shadow lines a head rail 2B is shown to indicate the orientation of the bracket assembly.

The third embodiment is shown with an actuator grip 37B that similar to the actuator grip 37A of the second embodiment. The third embodiment actuator grip 37B does no longer have the ledge 107A since this could interfere with the bi-directional linear movement of the actuator.

FIG. 10 clearly shows that this embodiment provides a clamping means 39B that locks the head rail carrier 33B against all linear of movement along the support leg 7B. The actuator means 31B acts in the same linear directions as the actuator of the first and second embodiment but the clamping means 39B is now an X-shaped resilient means. The X-shaped resilient clamping means 109B includes a central opening 111B for accommodating the stem 42B of the stemmed fastener 41B. It further comprises two pairs of legs, top left and right legs 113B, 115 B with end portions 117B, 119B and bottom left and right legs 121B, 123B with end portions 125B, 127B. The X-shaped resilient clamping means 109B can be formed by a pair of torsions springs 49B.

The arrangement of the actuator body 35B, the clamping means 39B and the operation of the assembly is generally similar to that of the first embodiment.

The recess 65B of actuator body 35B accommodates the X-shaped member or double torsion spring 49B. The left and right actuator walls 67B,69B extend along the oblong hole 36B. Optionally stiffening ribs 77B can extend from either side of the oblong hole 36B. The main difference is that the third embodiment recess 65B does not have a top wall. The length of the left and right actuator walls 67B,69B is chosen such that open sides remain allowing the top left and right ends 117B, 119B as well as the bottom left and right ends 125B, 127B of the X-shaped resilient clamping means 109B to engage the left and right slot wall's inner surfaces 19B, 21B. This effectively prevents movement in both linear directions along the length of the support leg.

In operation, when the actuator grip 37B is pulled the actuator body 35B will slide toward the bottom wall 25B of the support leg 7B and is pulled over the bottom left and right legs 121B, 123B of X-shaped clamping means 49B. As the actuator body 35B is being pulled the bottom portions of the left and right actuator walls 73B, 75B bear down on the bottom left and right clamping means ends 125B, 127BA pushing them inwardly and thus disengaging the ends 125BA,127B from the inner slot wall surfaces 19B,21B. The movement of the actuator body 35B will be stopped when the top of the oblong hole 36B abuts against the stationary stem 42B of fastener 41B. Continued pulling of the actuator grip 37B will now result in movement of the stemmed fastener 41B together with the head rail holder 33A. The top legs 113B, 115 B of the X-shaped clamping means with end portions 117B, 119B will still be against the inner wall surfaces 19B, 21B but this will not prevent the movement towards the bottom wall 25B of the support leg 7B due to the inward resiliency of the legs in combination with the profile 81B of the inner surfaces. The position of the head rail holder can thus be adjusted to a desired new position. Once that desired new position is reached the actuator grip 37B can be released. After releasing the grip the inwardly pushed lower legs of the resilient X-shaped clamping means will force the actuator body to move a little bit towards the top wall 23B of the support leg so that all four leg ends are free and lock to the inner surfaces 19B,21B of the slot. This movement is relative to the stationary stemmed fastener 41B so it will not act on the new position of the head rail carrier.

For movement in the opposite direction the actuator grip 37B is pushed and the actuator body 35B will slide toward the top wall 25B of the support leg 7B and is pushed over the top left and right legs 113B, 115B of X-shaped clamping means 49B. As the actuator body 35B is being pushed the top portions of the left and right actuator walls 72B, 74B bear down on the top ends 117B, 119B of the top left and right legs 113B, 115B pushing them inwardly and thus disengaging the ends 117B, 119B from the inner slot wall surfaces 19B,21B. The movement of the actuator body 35B will be stopped when the bottom of the oblong hole 36B abuts against the stationary stem 42B of fastener 41B. Continued pushing of the actuator grip 37B will now result in movement of the stemmed fastener 41B together with the head rail holder 33B. The bottom legs 121B, 123B with end portions 125B, 127B will still be against the inner wall surfaces 19B, 21B but this will not prevent the movement towards the top wall 23B of the support leg 7B due to the inward resilience of the legs. The position of the head rail holder can thus be adjusted to a desired new position. Once that desired new position is reached the actuator grip 37B can be released. The effect of releasing the grip will be that all four leg ends are free and lock to the inner surfaces 19B,21B of the slot, analogous to the effect explained in relation to the pulling movement.

In order to ensure a good grip of the X-shaped clamping means on the inner surfaces of the left and right side walls 19B,21B of slot 13B it is desirable that these surfaces are been provided with a suitable ribbed profile 81B.

The fourth embodiment bracket assembly 1C comprises the generally same parts as the previously described first, second third embodiments.

Figure 11:
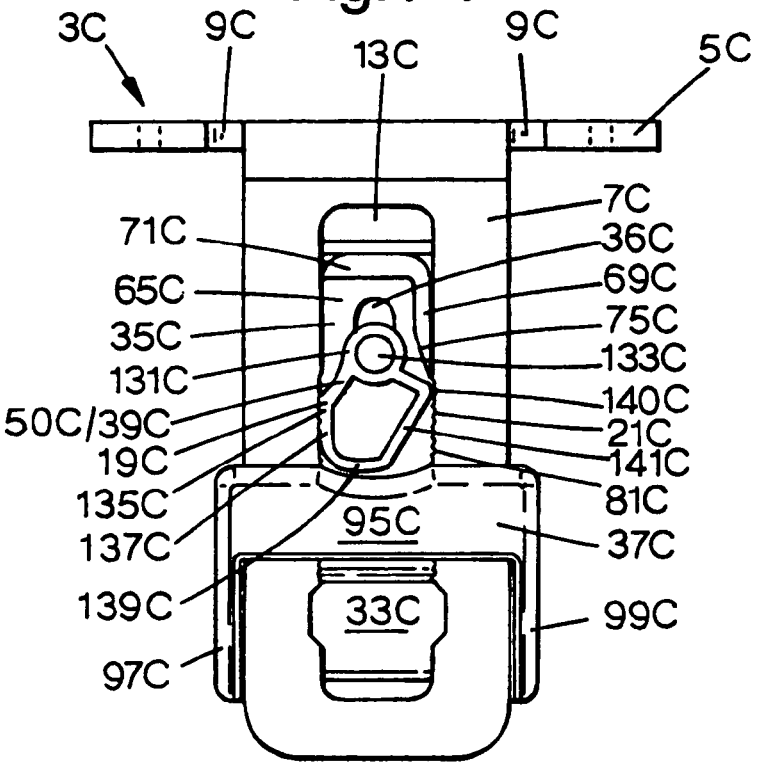
FIG. 11 shows the fourth embodiment bracket assembly from the rear and at the level of the actuator; the clamping means are in engaged position preventing adjustment of the position of the head rail holder.

FIG. 11 shows the arrangement of the actuator body 35C, the clamping means 39C and the operation of the assembly of the fourth embodiment bracket assembly.

The actuator body 35C and the clamping means 39C are different from the first three embodiments, but the same in function. The clamping means 39C is an expandable resilient means, preferably a plastic resilient member 50C. The actuator body 35C and the clamping means 39C are similarly assembled as to those of the first embodiment, in that the recess 65C of actuator body 35C accommodates a resilient member 50C. The recess 65C is a two-wall hook shaped recess having a top actuator wall 71C and right actuator wall 69C, the right actuator wall extending downward until the level of the bottom of oblong hole 36C or a bit further. The plastic resilient clamping member 50C comprises a base portion 131C with a mounting hole 133C for receiving the stemmed fastener 41C (not shown). Depending from the base portion 131C is leg portion 135C. The leg portion 135C is resilient, expandable and generally rectangular and hollow shaped and comprises a left leg 137C, a bottom leg 139C and a right leg 141C with a knee portion 143C for engaging the right inner wall surface 21C. The left and right legs 137C, 141C extend from the base 131C.

The stemmed fastener 41C (not shown) can be projected through the parts and held in place by front and rear circlips or other closure means.

In operation, when the actuator grip 37C is pulled downwardly the actuator body 35C will slide downwardly and over the resilient member 50C. As the actuator body 35C is being pulled downwardly over the resilient member 50C, the bottom portion 75C of the right actuator wall 69C bears down on the knee portion 143C pushing it inwardly and thus disengaging the knee portion 143C from the inner slot wall surface 21A. The left leg portion 137C has no knee portion to engage the inner wall surface of the support member. The resilient member 50C is preferably made from plastic and the shape of the knee portion 143C allows inward flexing as well as outward bias into engagement with the ribbed inner surface wall 21C of the slot 13C of the support leg 7C. The downward movement of the actuator body 35C will be stopped when the top of the oblong hole 36C abuts against the stationary stem 42C of fastener 41C. Continued downward pulling of the actuator grip 37C will now result in movement of the head rail holder 33C. The position of the head rail holder can thus be adjusted to a desired new position. Once that desired new position is reached the actuator grip 37C can be released. By releasing the grip the resilient member 50C will expand by it's inherent resiliency to its widest shape and lock knee portion 143C will lock to right, profiled inner surface 21C, while the left leg portion 135C will provide a general wedging force to the left inner surface 19C of the support member, without being actually engaged in a profiled portion. So in this embodiment, in order to ensure a good grip of the knee portion 143C on the right inner surface of the right side walls 21A of slot 13A it is desirable that this surfaces is provided with a suitable ribbed profile 81C. Although it is not necessary to provide the left inner surface 19C also with a ribbed profile, it is present for ease of production and also in order that the bracket can be assembled to the support leg on either side.

The operation is similar to that of the first and second embodiments. Like these embodiments the fourth embodiment is most suitable for situations where the support leg 7C is vertically oriented. The clamping means 39C, when engaged, prevents movement of the head rail holder 33C in one direction only; the downward direction so that the weight of the blind helps to engage the clamping means.

Figure 12:
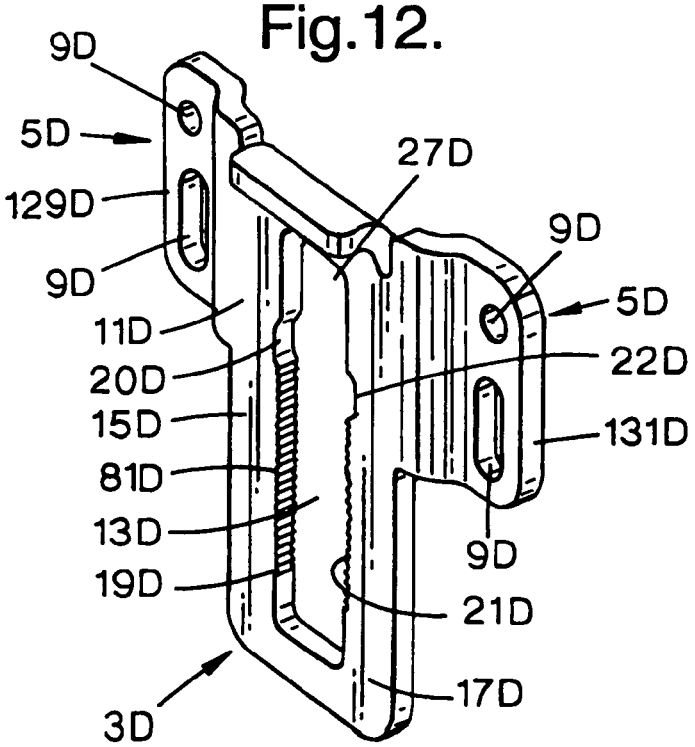
FIG. 12 shows a schematic perspective view of the stationary base member of the fifth embodiment bracket assembly for wall mounting.

A fifth embodiment base is shown in FIG. 12 and is specifically for use as a wall mounted bracket with the mounting portion and support leg extending generally vertically. In the description of this fifth embodiment like parts have the same referral numbers as those used in the first embodiment with suffix D.

FIG. 12 shows the stationary base member 3D, the mounting portion 5D, the support leg 7D, the screw holes 9D and the generally rectangular shaped support web 11D with the elongated, also generally rectangular slot 13D in the support web 7D. The base member 3D of the fifth embodiment is shown to have a mounting portion 5D parallel to the support leg 7D and on either side thereof, in the shape of a left mounting wing 129D and a right mounting wing 131D. The mounting wings 129D and 131D are provided with the screw holes 9D.

FIG. 12 also shows the elongated slot 13D including a pair of left and right parallel and spaced apart side walls 15D, 17D with opposite inner left or first and right or second surfaces 19D, 21D and a pair of opposite and parallel spaced apart top and bottom walls 23D, 25D with inner top and bottom surfaces 27D, 29D. The left and right inner wall surfaces 19D, 21D are provided with a suitable profile 81D, similar to the first embodiment. Near the top wall 27D, the slot is slightly wider by the accommodation of a left and right recess 20D, 22D in the left and right inner wall surfaces 19D, 21D. These surfaces are not profiled, these recesses facilitate the assembly to the slot of the clamping means 39D (not shown) in the same manner as that of the second embodiment. The clamping means 39D as that of the second embodiment is preferably also a torsion spring with a single winding and a pair of left and right legs extending downward on either side from the winding, and with straight end portions. This makes the assembly of the spring into the slot easier, as does the wider upper portion of the slot between left and right recesses 20D, 22D.

This invention is, of course, not limited to the above-described specific embodiments which may be modified without departing from the scope of the invention or sacrificing all of its advantages. In this regard the recesses (20A,22A, 20D, 22D) near top or bottom wall of the leg portion of the second and fifth embodiments are mutually exchangeable. Further, in this regard, the terms in the foregoing description and the following claims, such as, "upper", "lower", "left", "right", "top" and "bottom", have been used only as relative terms to describe the relationships of the various elements of the bracket assembly of the invention as shown in the orientation of FIGS. 1-12. It is specifically the case that the blind carrier can be mounted on either side of the support leg in the first four embodiments, which would already change the indications of left and right etc.

I claim:

1. A bracket assembly for adjustably mounting a head rail in spaced relationship to a wall or ceiling said assembly comprising: a stationary base member for mounting to a wall or ceiling surface, the base member comprising an elongated support leg and the support leg having an elongated slot comprised therein, the elongated slot comprising at least opposite first and second inner side wall surfaces; a head rail holder for carrying a head rail, the head rail holder being slidably mounted to the support leg by a stemmed fastener projecting through the slot of the support leg such that the head rail holder is slidable in first and second directions along the support leg; clamping means engageable with at least one of said first and second inner side wall surfaces of the elongated slot of the support leg for releasably retaining the head rail holder in different adjusted positions along the support leg, and actuating means for releasing or engaging the clamping means with said at least one inner side wall surface wherein the clamping means and the actuating means are mounted to the support leg by the stemmed fastener and wherein the actuating means is operatively connected to the clamping means by the fastener allowing linear movement of the actuating means for releasing or engaging the clamping means, the clamping means being an expandable, resilient means that in a first expanded position engages at least one of the inner side wall surfaces of the elongated slot of the support leg of the stationary base member and retains the head rail holder against linear movement in at least one direction and in a second non-expanded position is free of the at least one of the inner side wall surfaces of the elongated slot allowing linear movement of the head rail holder in both directions.

2. The bracket assembly of claim 1 wherein the clamping means is an expandable resilient means comprising an opening through which the stemmed fastener can project and at least a pair of engaging legs for resiliently engaging the first and second inner wall surfaces.

3. The bracket assembly of claim 1 wherein the actuating means includes an actuator body that is slidably contained between the first and second inner side wall surfaces of the slot and wherein the clamping means are contained within said actuator body while allowing engagement of the clamping means to at least one of the inner side wall surfaces of the slot.

4. The bracket assembly of claim 3 wherein the actuator body includes an oblong hole such that when the clamping means is in a first position of engagement to at least one of the inner side wall surfaces of the slot and the fastener is retained in that first position, the actuator body is slidable relative to said clamping means.

5. The bracket assembly of claim 4 herein the actuator body further includes at least one actuator wall which upon linear movement of the actuator body relative to the clamping means acts on the clamping means disengaging the clamping means from the inner wall surfaces of the slot.

6. The bracket assembly of claim 2 wherein the clamping means is a torsion spring comprising at least one winding and an opening through which the stemmed fastener can project and at least one pair of engaging spring legs for resiliently engaging the first and second inner wall surfaces.

7. The bracket assembly of claim 2 wherein the clamping means is an X-shaped resilient body having two pairs of engaging legs.

8. A bracket assembly for adjustably mounting a headrail in spaced relationship to a wall or ceiling, said assembly comprising: a stationary base member for mounting to a wall or ceiling surface, the base member comprising an elongated support leg and the support leg having an elongated slot comprised therein, the elongated slot comprising at least opposite first and second inner wall surfaces; a headrail holder for carrying a headrail, the headrail holder being slidably mounted to the support leg by a stemmed fastener projecting through the slot of the support leg such that the headrail holder is slidable in first and second directions along the support leg; clamping means engageable with the support leg for releasably retaining the headrail holder in different adjusted positions along the support leg, and actuating means for releasing or engaging the clamping means wherein the clamping means and the actuating means are mounted to the support leg by the stemmed fastener and wherein the actuating means is operatively connected to the clamping means by the fastener allowing linear movement relative to the clamping means for releasing or engaging the clamping means, wherein the clamping means is an expandable, resilient means that in a first expanded position engages at least one of the inner wall surfaces of the elongated slot of the support leg of the stationary base member and retains the headrail holder against linear movement in at least one direction and in a second non-expanded position is free of the at least one of the inner wall surfaces of the elongated slot allowing linear movement of the headrail holder in both directions.

9. The bracket assembly of claim 8 wherein the clamping means is an expandable, resilient means comprising an opening through which the stemmed fastener can project and at least a pair of engaging legs for resiliently engaging the first and second inner wall surfaces.

10. The bracket assembly of claim 9 wherein the clamping means is a torsion spring comprising at least one winding and an opening through which the stemmed fastener can project and at least one pair of engaging spring legs for resiliently engaging the first and second inner wall surfaces.

11. A bracket assembly for adjustably mounting a headrail in spaced relationship to a wall or ceiling, said assembly comprising: a stationary base member for mounting to a wall or ceiling surface, the base member comprising an elongated support leg and the support leg having an elongated slot comprised therein, the elongated slot comprising at least opposite first and second inner wall surfaces; a headrail holder for carrying a headrail, the headrail holder being slidably mounted to the support leg by a stemmed fastener projecting through the slot of the support leg such that the headrail holder is slidable in first and second directions along the support leg; clamping means engageable with the support leg for releasably retaining the headrail holder in different adjusted positions along the support leg, and actuating means for releasing or engaging the clamping means wherein the clamping means and the actuating means are mounted to the support leg by the stemmed fastener and wherein the actuating means is operatively connected to the clamping means by the fastener allowing linear movement relative to the clamping means for releasing or engaging the clamping means, the actuating means including an actuator body that is slidably contained between the first and second inner wall surfaces of the slot and wherein the clamping means is contained within said actuator body while allowing engagement of the clamping means to at least one of the inner wall surfaces of the slot, the actuator body including an oblong hole such that when the clamping means is in a first position of engagement to at least one of the inner wall surfaces of the slot and the fastener is retained in that first position, the actuator body is slidable relative to said clamping means, and wherein the actuator body further includes at least one actuator wall which upon linear movement of the actuator body relative to the clamping means acts on the clamping means disengaging the clamping means from the inner wall surfaces of the slot.

* * * * *